US005528892A

United States Patent [19]

Pesek et al.

[11] Patent Number: 5,528,892

[45] Date of Patent: Jun. 25, 1996

[54] FLEXIBLE TEXTILE SPINDLE ASSEMBLY

[75] Inventors: Thomas Pesek, Winterthur, Switzerland; Helmut Speiser, Weinstadt, Germany; Kurt Janser, Stuttgart, Germany; Hans-Peter Förstner, Bietigheim-Bissingen, Germany; Gunter Dürr, Freiberg, Germany

[73] Assignee: Gebruder Loepfe AG, Kempten, Switzerland

[21] Appl. No.: 280,999

[22] Filed: Jul. 27, 1994

[30] Foreign Application Priority Data

Jul. 28, 1993 [CH] Switzerland ..... 02293/93

[51] Int. Cl.[6] ..... D01H 7/08; D01H 7/18

[52] U.S. Cl. ..... 57/135; 57/130; 57/131; 384/230; 384/231; 384/239

[58] Field of Search ..... 57/130, 75, 132, 57/133, 134, 135, 131; 384/230, 231, 232, 233, 239, 237, 277

[56] References Cited

U.S. PATENT DOCUMENTS

| | | | |
|---|---|---|---|
| 3,076,306 | 2/1963 | Wagner | 57/135 |
| 3,708,888 | 3/1974 | Mandl | 57/135 |
| 3,797,219 | 3/1974 | Kieronski et al. | 384/233 |
| 3,841,077 | 10/1974 | Krauss et al. | 57/135 |
| 4,674,272 | 6/1987 | Widmer | 57/135 |
| 5,092,115 | 3/1992 | Stahlecker et al. | 57/132 |
| 5,201,170 | 4/1993 | Stahlecker et al. | 57/133 |
| 5,359,842 | 11/1994 | Braxmeier et al. | 57/134 |

FOREIGN PATENT DOCUMENTS

| | | | |
|---|---|---|---|
| 558023 | 6/1957 | Belgium | 57/134 |
| 515112 | 7/1955 | Canada . | |
| 0209799 | 7/1986 | European Pat. Off. . | |
| 523000 | 1/1993 | European Pat. Off. | 57/134 |
| 1150447 | 1/1958 | France | 57/130 |
| 1204630 | 8/1959 | France . | |
| 1293897 | 4/1962 | France . | |
| 2332466 | 1/1974 | Germany . | |
| 2749389 | 5/1979 | Germany . | |
| 3843651 | 8/1989 | Germany . | |
| 3942403 | 6/1991 | Germany . | |
| 4004046 | 8/1991 | Germany | 57/135 |
| 4121979 | 2/1992 | Germany . | |
| 379985 | 8/1964 | Switzerland | 57/132 |

*Primary Examiner*—William Stryjewski
*Attorney, Agent, or Firm*—Cushman, Darby & Cushman

[57] ABSTRACT

A spindle shaft is flexurally elastic at its shank part mounted in a bearing sleeve. The spindle shaft carries a belt-engaging wharve which is arranged underneath the neck bearing and to which a drive belt engages to rotate the spindle shaft. The bearing sleeve is arranged to have radial play within a spindle housing 10. The bearing sleeve is fastened at its lower end via a flexurally elastic tilting joint 40 to the spindle housing 10 connected rigidly to the spindle rail. The pulling force of the drive belt engaged to the wharve during operation deflects the bearing sleeve radially by tilting it about the tilting joint. Such deflection brings about, on the other hand, a pivoting of the bobbin-carrying upper part of the spindle shaft about the neck bearing in the opposite direction as a result of the bending moment occurring on the shank part, an inclination of the spindle shaft with its upper part is thus avoided.

6 Claims, 2 Drawing Sheets

Fig. 1
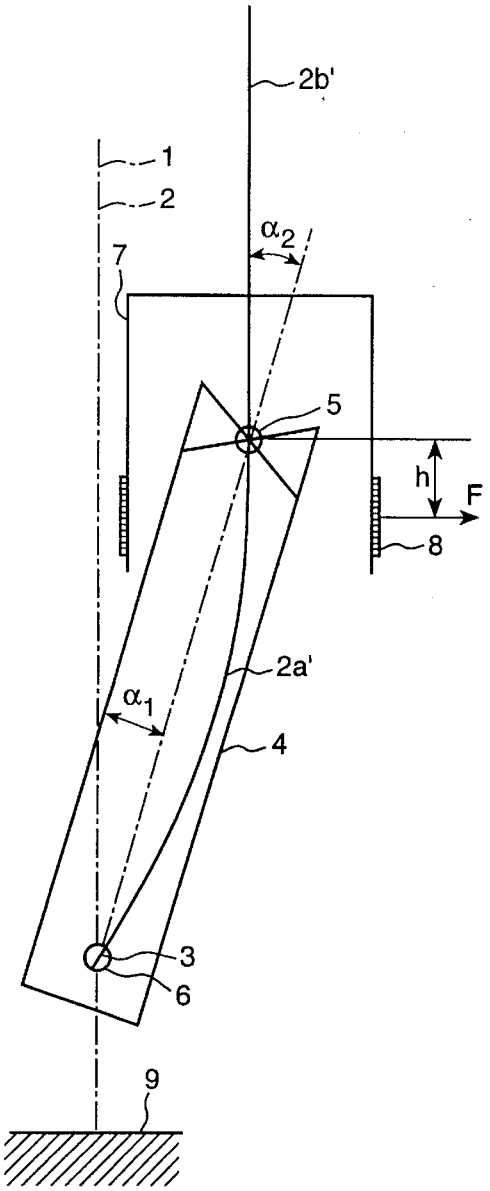
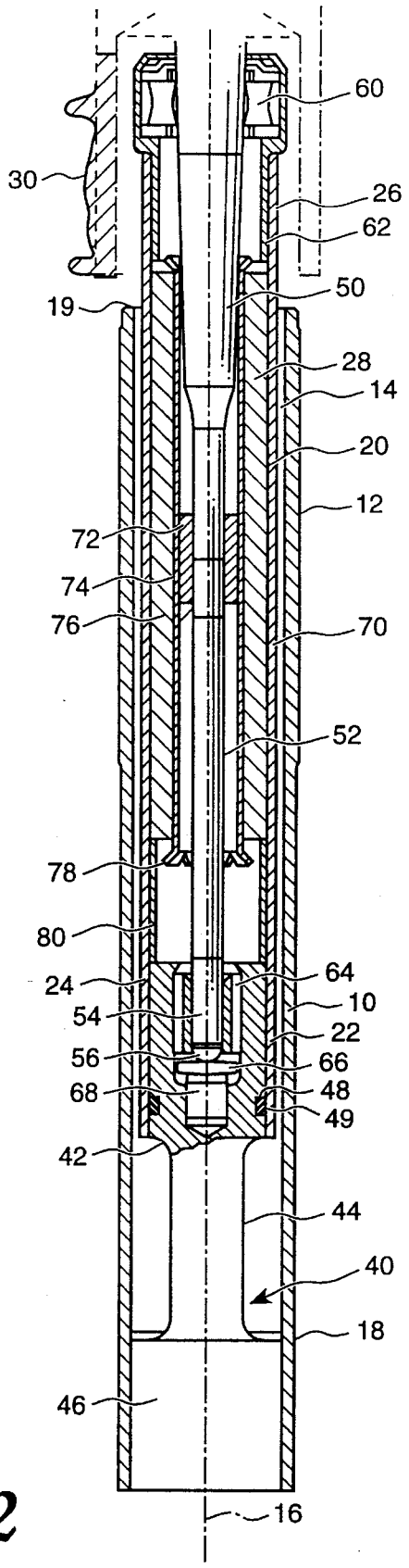
Fig. 2

FLEXIBLE TEXTILE SPINDLE ASSEMBLY

BACKGROUND OF THE INVENTION

1. Field of the Invention

The invention relates to textile spindle

2. Description of Related Art

Textile spindles, which can compensate unbalance by approximating the actual main massinertia axis to the axis of rotation of a spindle mounting over two degress of freedom of the spindle shaft, are already known from EP-A1-0,209,799. In this known textile spindle, the spindle shaft, the shank of which is supported rotatably in a spindle-bearing housing via a neck bearing and a step bearing, is capable of executing a wobbling movement about the neck bearing, counter to the effect of a damping device arranged within the spindle-bearing housing. The spindle-bearing housing is itself connected at a distance from the spindle rail,E via a mounting sleeve, to the first ends of axis-parallel flexural-spring bars which are arranged distributed over the circumference of the mounting sleeve and the opposite ends of which are anchored to the spindle rail via a further mounting sleeve. A better engaging wharve is arranged on the spindle shaft in the region of the neck bearing.

Consequently, the spindle shaft, together with the upper part carrying the yarn bobbin, can tilt about the neck bearing to the extent of the wobbling capacity counter to the effect of the damping device. The mutually parallel flexural-spring bars of equal length form, together with the mounting sleeve, a three-dimensional parallelogram-like connection, the imaginary pairs of joints of which lie respectively in one of two radial planes which are spaced axially from one another and which extend parallel to the spindle rail. The spindle-bearing housing can therefore, in practice, move only with the effect of a parallel displacement in the radial direction, counter to the spring tension of the flexural-spring bars. Since a belt pulling force is exerted in the region of the neck bearing as a result of the wharve arrangement, inclination of the spindle shaft or of its bobbin-carrying upper part is thus prevented. The spindle-bearing housing executes the radial movements at right angles to the spindle rail.

To compensate unbalance during the rotation of the spindle, the spindle-bearing housing, in the position displaced parallel out of the neutral position, executes, together with the associated mounting sleeve, a translational oscillating rotational movement. The spindle-bearing housing alone already constitutes a relatively large mass. In the supercritical rotational-speed range, the mass inertia impedes dynamic movability in the radial direction of the spindle shaft increasingly with an increasing rotational speed. This is accompanied by an increase in undesirable bearing reaction forces between the spindle shaft and the neck bearing and step bearing. This leads to a premature wear of said bearings.

If, despite the described stiffening effect of the mass involved, the dynamic radial flexibility of the spindle shaft (which is desirable to compensate for unbalance), is to be preserved, this mass must be compensated by for reduced spring rigidity of the flexural-spring bars, each simulating a double joint. In order to withstand the corresponding material loads as a result of alternating bend stresses or to avoid premature fatigue fractures of the flexural-spring bars, stringent requirements are placed on their design with regard to material and surface quality. It is evident that these requirements can be satisfied only at a corresponding cost outlay. In a considerable number of instances, the use of such textile spindles is there for impossible for reasons of cost.

SUMMARY OF THE PRESENT INVENTION

The object of the invention is to provide a textile spindle in which, by reducing the bearing reaction forces and by decreasing the stress load on the flexurally elastic elements involved, the outlay in terms of construction and in terms of material and production can be reduced and therefore the scope of use extended.

The above objective is realized based on the knowledge that the bearing reaction forces can be reduced most effectively by reducing the mass involved in the oscillations. This effect is promoted, on the one hand, by the flexurally elastic design of the shank of the spindle shaft between the neck bearing and the step bearing, such design making it possible to avoid a resiliently elastic shank-mounting element and therefore its co-oscillating mass. On the other hand, in the arrangement according to the invention of the tilting joint being at a distance from the neck bearing, allowing the radial deflection of the spindle shaft in the neck-bearing region, only a reduced part of the total mass co-oscillates and therefore has an effect on the mass inertia relevant here.

To decrease expense and effort of construction, it is pertinent that, a resiliently elastic shank-mounting housing for providing one degree of freedom is omitted. On the other hand, the tilting joint has to simulate only a single joint or have an imaginary joint axis in only a single horizontal plane. The vertical distance between the tilting joint and the spindle rail gives rise, for the radial movement of the neck bearing, to substantially reduced stress loads in this tilting joint loaded "in one axis".

According to a preferred embodiment of the invention, the wharve on the spindle shaft is arranged underneath the neck bearing. The result is that the deformation of the two resiliently elastic elements, i.e., the shank part of the spindle shaft and of the tilting joint, leads to opposite deflections relative to the upper part of the spindle shaft which virtually compensate one another. Thus, the deflection resulting from the tilting of the bearing sleeve causes an inclination of the spindle shaft in a direction approximately corresponding to the belt force, whilst the deflection of the upper part of the spindle shaft, arising from the bending of the shank part of the latter, takes place in the opposite direction. The upper part of the spindle shaft consequently assumes an approximately perpendicular position to the spindle rail.

Furthermore, according to a preferred embodiment of the present invention the tilting joint is spaced from the neck bearing approximately by the length of the shank part of the spindle shaft, such that the extent of flexurally elastic deformation in the tilting joint can be kept low for a given radial movement of the neck bearing out of the neutral position.

BRIEF DESCRIPTION OF THE DRAWINGS

The textile spindle according to the invention is explained below by means of several exemplary embodiments and with reference to the drawing, in which:

FIG. 1 is a diagrammatic representation of deformation ratios on a preferred embodiment of the textile spindle according to the present invention;

FIG. 2 shows the textile spindle according to the preferred embodiment in axial section.

DETAILED DESCRIPTION OF THE PREFERRED EMBODIMENTS

Figure 4:
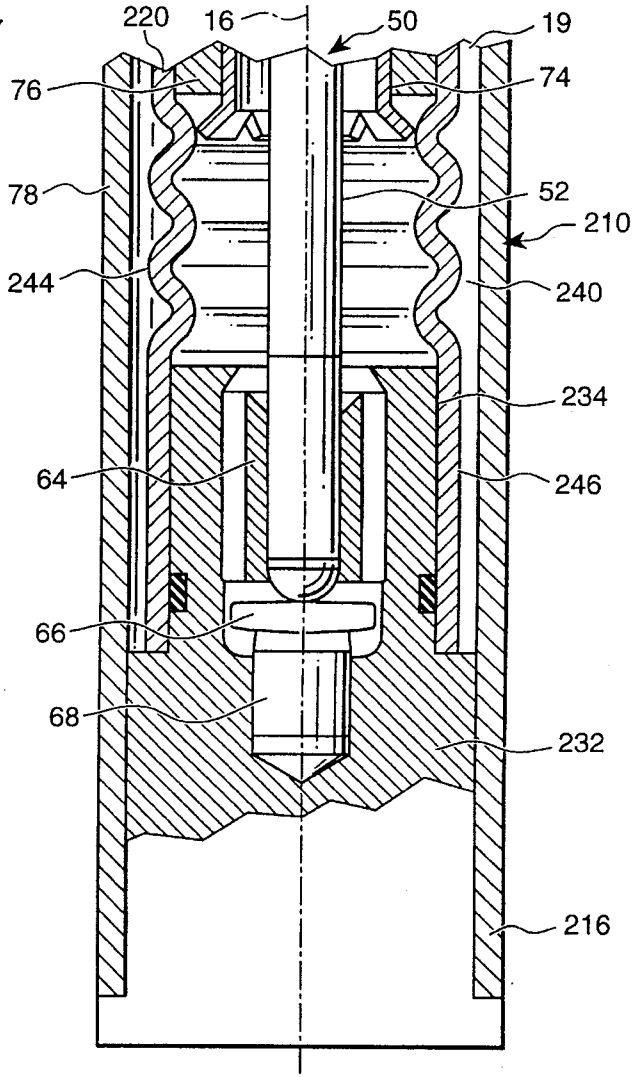
FIGS. 3 and 4 are respective partial views of further embodiments of the textile spindle, likewise in axial section.

In the diagrammatic representation of the textile spindle as seen in FIG. 1, the neutral position of a bearing axis is designated by 1, said neutral position also corresponding to the neutral position of the spindle shaft 2 represented by its axis. The bearing axis 1 is intersected by an imaginary joint axis 3 extending in a horizontal plane (i.e., out of the paper) and belonging to a flexurally elastic tilting joint. The tilting joint, in reality connected rigidly to the spindle rail, is shown at 9 as held fixedly at one end, whilst the lower end of a bearing sleeve 4 is connected at its other end. In the bearing sleeve, 4 which is consequently pivotable about the joint axis 3, a flexurally elastic shank part 2*a*' (shown curved) of the spindle shaft 2 is mounted rotatably in a neck bearing 5 and in a step bearing 6 the latter of which with the joint axis 3.

During operation, a pulling force E (corresponding to the direction of the arrow) of a drive belt, indicated as engaging at 8, acts on a wharve 7 4 seated on the spindle shaft 2. The bearing sleeve 4 has assumed, under the effect of the pulling force E, a position pivoted relative to the bearing axis 1 through the angle $\alpha 1$. The point of engagement 8 of the pulling force F on the wharve at the distance h underneath the neck bearing 5 cause a bending moment F * h on the shank part 2*a*. As a result of this bending moment, indicated by the illustrated curvature of the shank part 2*a*', pivoting of the bobbin-carrying upper part of the spindle shaft 2 about the neck bearing 5 into the axial position 2*b*' takes place. The amount of pivoting corresponds to the angle $\alpha 2$ and is opposite in direction to the pulling force F. With appropriate dimensioning, the absolute value of the angles $\alpha 1$ and $\alpha 2$ is equal. The upper part 2*b*' of the spindle shaft therefore assumes a position parallel to the bearing axis 1.

The textile spindle represented in solid form in FIG. 2 comprises a tube-like spindle housing 10 which is provided with an external thread 12 for rigid fastening in a bore of the spindle rail (not shown). A thin-walled intermediate tube 20 forming the bearing sleeve 4 of FIG. 1 extends in the hollow interior 14 of the spindle housing 10 virtually over the entire length of the latter and concentrically relative to the longitudinal axis 16 of the housing (corresponding to the mounting axis 1 in FIG. 1). A cup-shaped head piece 42 is fastened rigidly into the lower end 22 of the intermediate tube 20 by means of a press fit 24. The head piece 42 forms part of a single-axis tilting joint, designated as a whole by 40, which comprises a web 44 and a foot piece 46. The tilting joint 40 assumes with its web 44 a position coaxial relative to the longitudinal axis 16 of the housing. The foot piece 46 is pressed into the lower end 18 of the spindle housing 10. The tilting joint 40 is in one piece and consists of steel, being made flexurally elastic as a result of a reduction in cross-section in the region of the web 44.

A bearing bush 62 receiving a neck bearing 60 is pressed into the upper end 26 of the intermediate tube 20. The neck bearing 60 rotatably receives a spindle shaft 50, described in more detail below, which carries, on an upper part (not shown), a belt-driven wharve 30 and a yarn bobbin (not shown). The wharve 30, connected rigidly in terms of rotation to the spindle shaft 50, is arranged underneath the neck bearing 60, (i.e., offset axially relative to the neck bearing 60 in the direction of the tilting joint 40).

The shank part 52 of the spindle shaft 50, which extends inside the intermediate tube 20 underneath the neck bearing 60, is flexurally elastic as a result of an appropriate narrowing. A step bearing 64, designed as a sliding bearing and arranged in the cup-shaped head piece 42, receives an end piece 54 of the shank part 52. The spherically shaped end face 56 of end piece 54 rests on a sliding plate 66 acting as an axial bearing. A pin 68 inserted into the head piece 42 supports the sliding plate 66 and consequently the entire spindle shaft 50 in the intermediate tube 20. The neck bearing 60 is a known radial roller bearing equipped with enveloping-circle play between the shaft shank 52 and bearing rollers. The step bearing 64 has sufficient bearing play to allow for errors in alignment between the shank-part axis and the bearing axis which result from bending. The bearing axis coincides with the housing axis 16 when the intermediate tube is not deflected out of the vertical position shown.

The flexurally elastic shank part 52 is surrounded, approximately in the region of the greatest bending, by a damping device 70 provided in the intermediate tube 20. The damping device 70 has a guide bush 72 designed as a sliding bearing, a thin-walled spring sleeve 74, and a damping element 76 designed as a helical spring. The guide bush 72, which receives the shank part 52 of the spindle shaft 50, is pressed into the spring sleeve 74 and transmits the forces exerted on the former. The spring sleeve 74 is arranged in the damping element 76 and is secured by end widenings 78. The spring sleeve 74 distributes the absorbed forces over the length of the damping element 76, which is supported on the inside 28 of the intermediate tube 20. The damping element 76 is held in the axial direction between a thin-walled spacer bush 80, standing on the head piece 42, and the bearing bush 62.

At least the cup-shaped head piece 42 contains an oil bath for bearing lubrication, but such an oil bath can also fill the intermediate tube 20 completely or partially, so that the damping device 70 is likewise located in the oil bath. Accordingly, a sealing ring 49 cooperating with the intermediate tube 20 is provided in a circumferential groove 48 provided in the head piece 42, in order to prevent oil from flowing out.

When the spindle is in operation, under the influence of the drive-belt force (belt pulling force) engaging the wharve 30, the intermediate tube 20 can be deflected in the spindle housing 10 by the amount of the radial play indicated at 19 or can tilt out of the housing axis 16, specifically about the tilting joint 40 connected to the lower end of said intermediate tube 20. The stress loads thereby occurring in the web 44 are low as a result of the axial distance from the neck bearing 60.

Since the radial deflection of the intermediate tube or bearing sleeve 20, together with their parts, can take place by tilting about the tilting joint 40, only a fraction of the mass involved co-oscillates. The lower end of the bearing sleeve, of low mass itself in any case, remains virtually stationary in this respect. The tilting joint 40 is subjected to low stress loads as a result of the distance from the, neck bearing 60 or because of a corresponding lever effect. Consequently, no stringent requirements of material and machining, especially surface quality, need to be satisfied and the tilting joint can be produced in a cost-effective way. As a result of the flexurally elastic design of the shank part of the shaft itself, the deflection of the upper part of the spindle shaft about the neck bearing takes place simply and with low mass.

Figure 3:
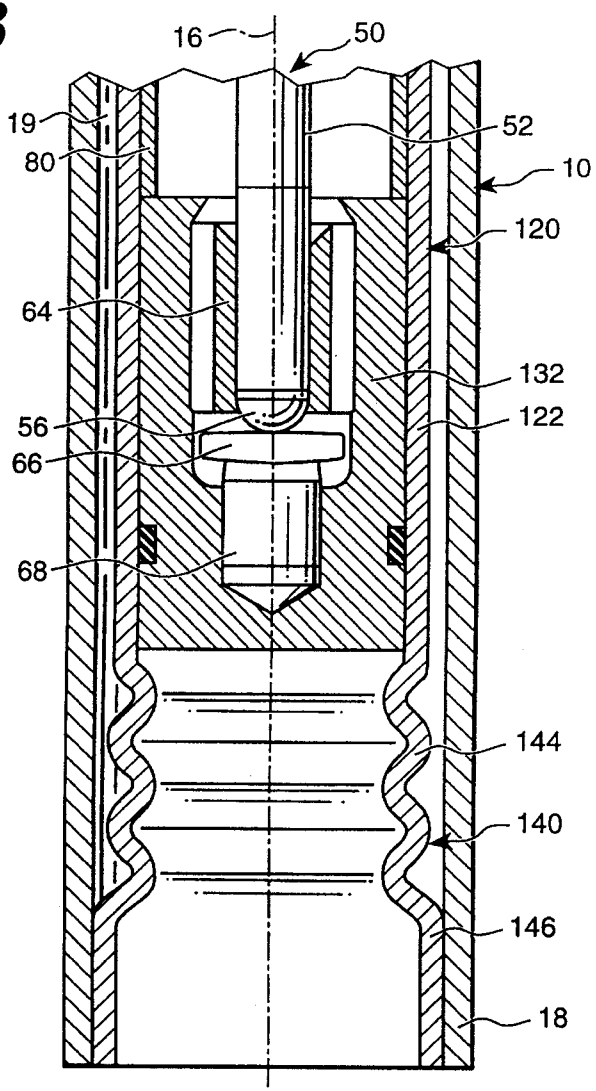

The exemplary embodiment according to FIG. 3 corresponds entirely to that according to FIG. 1 in terms of the design and mounting of the spindle shaft 50, with like parts bearing identical reference symbols. However, it differs mainly in that a tilting joint 140 is provided as part of an intermediate tube 120. Pressed into a lower end part 122 of the intermediate tube 120, and spaced from the neck bearing and therefore from the spindle rail, is an independent cup-shaped bearing element 132 which replaces the head piece 42 according to FIG. 1 in terms of its function as a bearing mounting. The tilting joint 140 comprises, in addition to the end part 122, a corrugated tubular portion 144, made flexurally elastic, and a tubular foot part 146. This foot part 146 is itself fastened rigidly in the spindle housing 10, in that it is wider in diameter relative to the part 122 and is pressed into the lower end 18.

From a functional point of view, the embodiment according to FIG. 3 is no different from that according to FIG. 2. Here too, the tilting joint 140 is designed as a resiliently elastic element.

In the exemplary embodiment according to FIG. 4, the resiliently elastic element, designated as a whole by 240, is again integrated into the intermediate tube 220. A cup-shaped bearing element 232, corresponding functionally to that according to FIG. 3, projects into the spindle housing 210 from below and is fastened rigidly at a lower end 216. A foot part 246 of the tilting joint 240, which comprises a corrugated tubular portion 244, is pressed onto a collar 234 of narrowed diameter of the bearing element 232. The part of the intermediate tube 220 surrounding the damping device 70 directly adjoins the tubular portion 244.

The design according to the embodiment shown in FIG. 4 makes it possible to reduce even further the oscillating mass of the textile spindle involved in the compensation of unbalance, in that, in particular, the bearing element 232 and the parts supported in the latter are held fixedly.

In the embodiments illustrated in to FIGS. 3 and 4, the flexurally elastic flexible part of the tilting joints 140 and 240 is formed by a corrugated portion of the intermediate tube 120 or 220. This flexibility can alternatively be obtained by means of other measures sufficiently reducing the rigidity of the corresponding tubular portion and, at the same time, can maintain the textile-spindle construction described in either case. Thus, for example, it is possible to work helically extending slots or perforations into the respective tubular portion, so that webs acting as flexural :springs are formed.

Instead of designing the tilting joint as part of another (i.e., integrating it into the intermediate tube or into the bearing housing), it can likewise be designed as an independent component in accordance with the tilting joint 40 of FIG. 1.

In principle, instead of an arrangement between the spindle housing and the intermediate tube, as seen in FIG. 2, or instead of integration into the intermediate tube as seen in FIGS. 3 and 4, it is possible to integrate the tilting joint provided according to the present invention into the spindle housing, specifically, directly above the bearing element which, is pressed into the lower end of the spindle housing. In this case, the rigid holding element is formed by the main part of the spindle housing adjacent and above the tilting joint.

The statements made above apply accordingly to the possibilities of designing the tilting joint for integration into the spindle housing. As regards the resilient elastic webs formed by helical slots, it can be expedient to provide, for the part of the spindle housing equipped with such slots or perforations, a cover which encloses these and which is formed, for example, by a thin-walled tubular piece.

In principle, the tilting joint can be provided in the part of the intermediate tube 120 or 220 adjacent and above the bearing part 132 or 232, without prejudicing the operative principle of two resiliently elastic degrees of freedom of the spindle shaft, which are independent of one another.

What is claimed is:

1. A spindle assembly comprising:

a tubular spindle housing;

a bearing sleeve tiltably disposed within said spindle housing and including a neck bearing and a step bearing, said bearing sleeve and said spindle housing being joined by a tilting joint provided at one end of said bearing sleeve; and a spindle shaft having a flexible shank portion, and a belt-engaging portion located adjacent to said neck bearing and spaced away from said neck bearing in a direction towards said tilting joint, said spindle shaft being rotatably supported within said bearing sleeve by said neck bearing and said step bearing.

2. A spindle assembly as claimed in claim 1, wherein said tilting joint comprises at least one elastically flexble web member.

3. A spindle assembly as claimed in claim 2, wherein said at least one elastically flexible web is a material portion joining said bearing sleeve and said spindle housing having a plurality of helical slots formed therein.

4. A spindle assembly as claimed in claim 2, wherein said web member is arranged coaxial to an axis of said spindle shaft in an unflexed state.

5. A spindle assembly as claimed in claim 1, wherein said tilting joint comprises a flexible and corrugated portion of said bearing sleeve.

6. A spindle assembly as claimed in claim 1, wherein said tilting joint is formed as part of said bearing sleeve and is contained within said spindle housing.

* * * * *